US005213468A

United States Patent [19]

Sexton et al.

[11] Patent Number: 5,213,468

[45] Date of Patent: May 25, 1993

[54] BEARING FLUSHING SYSTEM

[75] Inventors: James H. Sexton, Lansing; Virgil J. Beaty, Louisburg, both of Kans.

[73] Assignee: Fairbanks Morse Pump Corporation, Kansas City, Kans.

[21] Appl. No.: 840,006

[22] Filed: Feb. 24, 1992

[51] Int. Cl.[5] ..... F01D 11/00

[52] U.S. Cl. ..... 415/121.3; 415/111; 415/115; 277/71; 417/431

[58] Field of Search ..... 415/121.3, 109, 110, 415/111, 115, 116, 117; 417/423.12, 423.13, 423.8, 430, 431; 277/71, 79, 135

[56] References Cited

U.S. PATENT DOCUMENTS

| | | | |
|---|---|---|---|
| 3,295,753 | 1/1967 | Butts et al. | 417/423.8 |
| 3,620,639 | 11/1971 | Gaffal | 415/111 |
| 3,697,194 | 10/1972 | Holmes | 417/430 |
| 4,063,849 | 12/1977 | Modianos . | |
| 4,209,178 | 6/1980 | MacKenzie | 277/135 |
| 4,389,052 | 6/1983 | Shimizu et al. | 415/111 |
| 4,462,751 | 7/1984 | Smith et al. . | |
| 4,543,038 | 9/1985 | Kitaguchi | 415/115 |
| 4,874,575 | 10/1989 | Dunn et al. . | |
| 4,877,371 | 10/1989 | Putt . | |
| 5,005,990 | 4/1991 | Wotring | 415/111 |
| 5,046,920 | 9/1991 | Higashi et al. | 415/111 |
| 5,072,949 | 12/1991 | Lopperi | 277/71 |
| 5,141,411 | 8/1992 | Klaeger | 417/430 |

*Primary Examiner*—Edward K. Look
*Assistant Examiner*—Mark Sgantzos
*Attorney, Agent, or Firm*—Hovey, Williams, Timmons & Collins

[57] ABSTRACT

A bearing flushing system is provided that enables the clearance between a bearing and shaft to be flushed with water but prevents the backflow of the pumped liquid into the region. The system hereof includes a flow restrictor located downstream of the bearing which presents a second clearance between the shaft to screen out particulates. A ring may be provided between one of a pump impeller and the shaft downstream of the flow restrictor to provide an additional backflow restriction.

6 Claims, 2 Drawing Sheets

DETAIL A

DETAIL B

DETAIL C

BEARING FLUSHING SYSTEM

BACKGROUND OF THE INVENTION

1. Field of the Invention

This invention relates to bearing flushing system for pumps and the like that are exposed to materials that would ruin or degrade the bearings. The bearing flushing system hereof includes a flow restrictor that is designed to permit the passage of flushing water but resist the infusion of contaminants into the bearing surfaces.

2. Description of the Prior Art

Pumps can be designed to handle and move a large quantity of liquids, including those carrying or containing solid materials and liquids that contain corrosives or other materials that would damage the pump if they come in contact with the bearing surfaces between the housing and the shaft or impeller. For example, pumps have been developed which move municipal sludge or other sediment-containing slurries having a large quantity of suspended solids such as twigs, rags, glass, grit, or sand. In many industrial applications, pumps must handle highly corrosive acids.

A pump useful in such environments is shown in U.S. Pat. No. 4,063,849 entitled Non-Clogging, Centrifugal, Coaxial Discharge Pump. The pump disclosed therein is designed to be at least partially submerged in fluid containing sediment or sludge. It includes a centrally located, normally vertically oriented shaft for driving the impeller, at least one of the bearing surfaces for the shaft being located below the water level of the fluid to be pumped.

In order to isolate the bearing surfaces from such contaminants, and to lubricate and cool the bearing surfaces, water has been employed as a medium to flush the bearing surfaces. Water is injected into the bearing surfaces at a pressure higher than the internal pressure of the pump. This is designed to ensure a positive flow of cleansing and lubricating fluid to the bearing surfaces. The bearings are designed with a lubricating groove or grooves that pass through the entire length of the bearing surfaces. The water thus is permitted to flow through the bearing and to pass through the other components of the system.

U.S. Pat. No. 4,462,751 entitled Centrifugal Pump Improvement discloses a pump for moving liquids but does not specifically recite any bearing flushing system. U.S. Pat. No. 4,877,371 entitled Pump, discloses a pump for moving dirty, viscous, hazardous or corrosive liquids but positions one of the pump bearings away from the liquid and does not provide for flushing lower bearings which may be submerged in the liquid.

However, when the pump is at least partially submerged such that one or more of the bearings is below the surface level of the pumped medium, there is a substantial risk that backflow of the pumped medium may contaminate the bearing surface with grit, sand, acid or the like. Maintaining the water flow to flush the bearings when the pump is not operating may be expensive both in terms of the expense of the water and the labor necessary to monitor the flushing operation. If the water supply to flush the bearing is stopped or interrupted, the backflow of contaminants may enter the bearing, leaving grit or the like which is extremely difficult to remove without disassembling the pump and removing the bearing. Given that such pumps often move sewage or sludge and may be extremely large, this is a situation to be avoided if at all possible.

Accordingly, there has developed a real need for a backflow restrictor which can be used in connection with a flushing system for pumps. Such a flow restrictor must allow clean flushing water to flow into the bearing and through the seal, but resist the entry of the pumped medium, and especially suspended particulates, into the bearing surfaces. Yet further, there has developed a need for a bearing flushing system that will reduce the amount of flushing water required and, when the flow of flushing water is discontinued, resist the entry into the bearing surfaces not only of small solids carried by the liquid but of contaminating liquids such as acids or other corrosives as well. Such a seal must nonetheless be compatible with existing pump systems so that radical modifications are not necessary to accommodate such a system. In particular, a bearing flushing system must be able to withstand exposure to and resist entry of contaminant liquids when some of the components of the flushing system are in direct contact with the contaminant liquid and submerged therein, but nonetheless admit the passage of flushing liquid therethrough.

SUMMARY OF THE INVENTION

These problems are largely solved by the bearing flushing system of the present invention. That is to say, the bearing flushing system hereof allows water to flush the bearing surfaces but, when the flow of flushing water is discontinued, seals the bearing surface against the entry of contaminants from the pumped medium. The bearing flushing system hereof also reduces the flow of flushing water therethrough, making continuous flushing more acceptable and affordable.

The present invention is particularly useful in a Vertical Turbine Solids Handling Pump such as is shown, for example, in U.S. Pat. No. 4,063,849, the disclosure of which is incorporated herein by reference. The invention hereof includes a restrictor bushing, which serves as a backflow restrictor, positioned between the shaft and its surrounding bowl or housing, and downstream (with respect to the flushing system) of the bearing to be protected. The system preferably includes a throttle ring located further downstream and inside the housing or bowl. The throttle ring is positioned intermediate the bowl and the impeller to further limit the entry of solids into the bearing surfaces.

The restrictor bushing is closely toleranced so that enough clearance is provided to permit a positive flow of flushing water therethrough but deny the entry of backflowing contaminants from the pumped liquid medium. The clearance between the bowl throttle ring and the impeller surface is greater as the bowl throttle ring screens out larger particles while the restrictor bushing limits the passage of smaller particles. A two-stage system for limiting the entry of contaminants is thus provided which protects the bearing from contamination. The bearing upstream of the restrictor bushing is preferably provided with a spiral groove for channeling flushing water therealong to trap and discharge any particles which pass the restrictor bushing.

In some applications it may be desirable to include a retaining ring which limits the movement of the restrictor bushing in an axial direction along the shaft. In other circumstances, it may be desirable to locate the retaining ring to permit some axial "floating" of the restrictor bushing or eliminate the retaining ring entirely. By permitting the restrictor bushing to "float", the bushing may be carried upwardly by backflowing fluid to positively block the passage the contaminants into the bearing. This "float" system may be particularly desirable where the contaminant contains fewer solid particles but includes corrosive liquids such as acids that must be prevented from entry.

DESCRIPTION OF THE PREFERRED EMBODIMENT

Figures 1, 2:
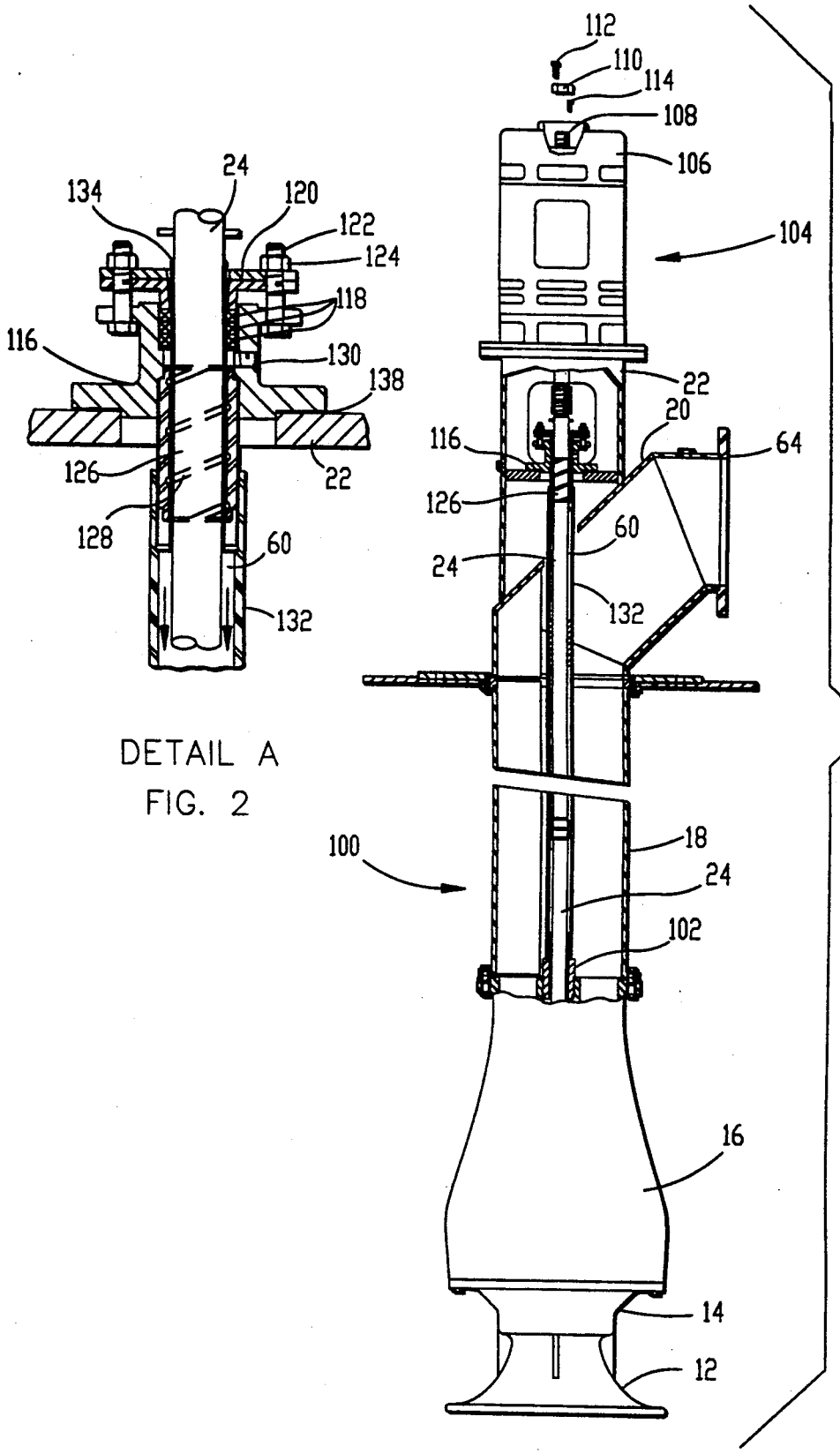
FIG. 1 is a side elevational view of a pump incorporating the bearing flushing system in accordance with the present invention, with portions of the pump shown in section.
FIG. 2 is an enlarged fragmentary vertical cross sectional view of the area within detail A of FIG. 1 showing the flushing flush intake.

The preferred bearing flushing system of the present invention is particularly adapted for use with a vertical solids handling pump 100. Such a pump is generally shown in U.S. Pat. No. 4,063,849 to Modianos entitled Non-Clogging, Centrifugal, Coaxial Discharge Pump, the disclosure of which is incorporated herein by reference. While the bearing flushing system hereof is not limited to a pump of this particular design, the pump as disclosed therein is designed for pumping sewage, sludge and other trashy wastes and for partial submergence therein where the bearing flushing system hereof is particularly useful. Accordingly, like reference characters will refer to the components of that pump as disclosed in that patent unless expressly stated otherwise.

Broadly speaking, pump 100 includes inlet 12, suction cover 14, diffusion casing 16, intermediate section 18 (which may be of varying lengths as indicated by the break therein), and discharge elbow 20. A discharge bearing housing 22 extends upwardly from elbow 20 and supports a vertical drive shaft 24 for driving an impeller 15, shown best in FIG. 3. The shaft is preferably of a hard, abrasive-resistant material such as stainless steel, and may be coated with an abrasive-resistant material on the surface thereof. A center passageway 60 defined by an enclosing tube receives shaft 24 therein and extends downwardly to mount on an adapter 102, best seen in FIG. 3. Shaft 24 is driven by electric motor 104 which need not be of the submersible type as it is typically located above the water level WL of the pumped liquid. Motor 104 includes a cover 106 which is fastened to a motor shaft 108 by a nut 110 held in place by bolt 112 and key 114, shown in an exploded view in FIG. 1.

Figure 3:
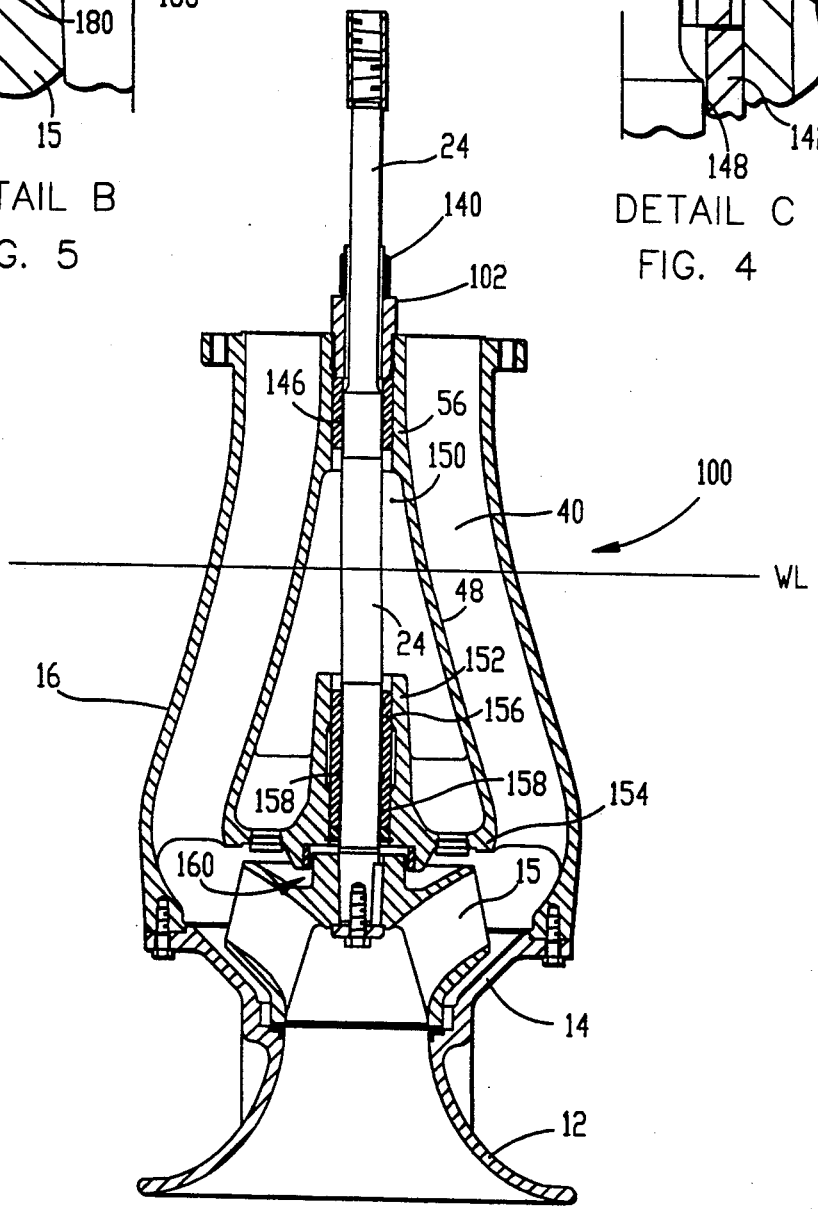
FIG. 3 is an enlarged vertical cross sectional view of the normally lower portion of the pump of FIG. 1 showing the central bearing and lower bearing.

Flushing water enters the pump 100 via a cast iron packing box 116, shown in detail in FIG. 2. A plurality of packing rings 118, preferably of graphite impregnated synthetic resin are received within the packing box 116 intermediate the packing box and the shaft 24. Annular gland 120 is of cast iron and is compressed axially against the packing rings 118 by a plurality of bolts 122 and nuts 124 circumferentially spaced around the gland 120 and the packing box 116. A packing box connector bearing 126 is threadedly received within packing box 116 and is preferably of bronze. The packing box connector bearing 126 includes a generally downwardly spiraling groove 128 for receiving water entering packing box 116 through port 130 which is internally threaded for receiving a suitable conduit or fitting therein. Packing box connector bearing 126 is also threaded into the enclosing tube 132 forming center passageway 60. A stainless steel top shaft sleeve 134 is fitted to shaft 24 for rotation therewith inside packing box connector bearing 126 and packing rings 118. Water slinger 136 in the form of a rubber washer is positioned around shaft 24 above gland 120 to deflect any water leaking between packing rings 118 and shaft 24, and packing box gasket 138 is positioned between packing box 116 and housing 22. The shaft 24 may be unitary as shown in FIG. 2 of the '849 patent or in a plurality of threadedly coupled shaft sections as shown in FIG. 1 of the present application.

Enclosing tube 132 extends downwardly from packing box connector bearing 126 to adaptor 102 as shown in FIG. 1. Adaptor 102 (FIG. 3) includes an externally threaded upper portion 140 for threadedly receiving enclosing tube 132 thereon and an externally threaded lower portion 141 (FIG. 4) for connecting to a housing identified as conical member 48. An upper bowl bearing 142 is positioned at or near the peak 56 (FIG. 3) of conical member 48 and below adapter 102. An annular space 144 is located between the adapter 102 and shaft 24. Upper bowl bearing 142 is provided with a downwardly spiraling groove 146 and includes a sufficient annular gap 148 between the bearing 142 and the shaft 24 to permit the passage of flushing water therethrough.

Annular gap 148 (FIG. 4) fluidically communicates with a chamber 150 surrounding shaft 24 and within conical member 48. At the lower end of conical member 48, bearing support sleeve 152 extends in a generally upright, axially aligned direction from the sole portion 154 of the conical member 48. Bearing support sleeve 152 is generally cylindrical in configuration for supporting lower bowl bearing 156 therein. Lower bowl bearing 156 is provided with at least one and preferably a pair of downwardly spiraling grooves 158 extending axially along the length thereof for channeling flushing water therethrough and for receiving contaminate particles which have backflowed past a flow restrictor unit 160. Flow restrictor unit 160 is located downstream of the bearing with respect to the direction of flow of the flushing water, as is better shown in FIG. 5.

Figure 5:
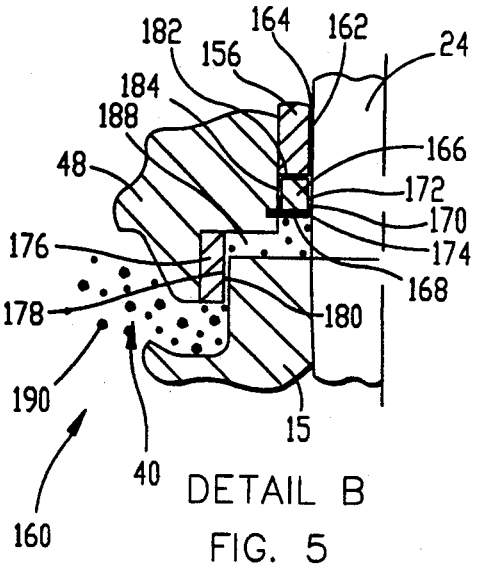
FIG. 5 is an enlarged fragmentary vertical cross sectional view of the area within detail C of FIG. 2 showing the lower bearing region.

Turning now to FIG. 5, bearing 156 presents an inner face 162 for defining an annular first clearance 164 between the inner face 162 and shaft 24. First clearance 164 is preferably between 0.016 and 0.022 inches in, for example, a pump 100 having a 16 inch diameter free end 64 (FIG. 1). Flow restrictor 160 includes a restrictor bushing 166 which may be held in position by retaining ring 168. Restrictor bushing 166 is preferably made of a self-lubricating material or combination of materials such as polytetrafluoroethylene (PTFE), commonly sold under the trademark Teflon ®. Retaining ring 168 is preferably made of stainless steel. The inner surface 170 of restrictor bushing 166 defines a second clearance 172 between the restrictor bushing 166 and the shaft 24. Preferably, in the case of a pump 100 having a 16 inch outlet, the second clearance 172 is between 0.005 and 0.010 inches. The retaining ring 168 presents a smaller inside diameter 174 than the diameter of the inner surface 170 of restrictor bushing 166 so that the distance between the shaft 24 and the inner surface 170 of the restrictor bushing 166 is greater than or equal to the second clearance 172.

A throttle ring 176 is located on the lowermost portion of conical member 48 opposite impeller 15. Throttle ring 176 is preferably constructed of a hard, abrasive-resistant material such as stainless steel and defines a third clearance 180 between the inner surface 178 thereof and the opposing outer face of the impeller 15. Third clearance 180 is preferably between 0.026 and 0.033 inches in the case of a pump 100 having a 16 inch diameter output, and in any event, greater than the second clearance 172. A fourth clearance 182 is provided between the restrictor bushing 166 and the radially inward oriented face 184 of conical member 48 which is preferably about 0.006 to 0.010 inches in a pump 100 having a 16 inch diameter outlet. The fourth clearance acts to lubricate and cool the restrictor bushing 166 and serves as a further barrier to the entry of contaminant liquid. The flushing water is preferably provided at a flow rate of about 2.5 gallons per minute and flows through first clearance 164 and second clearance 172 at about four feet per second in a pump 100 having a 16 inch outlet.

The operation of the bearing flushing system hereof can best be described with reference to the direction of flow of the flushing water. The flushing water proceeds along a flowpath which enters port 130 of packing box 116 and proceeds downwardly between packing box connector bearing 126 and shaft 24 and through the grooves 128 thereof. The flowpath of the flushing water then moves downwardly through central passageway 60 as generally indicated by the arrows in FIG. 2. The flushing water advantageously cools and lubricates the bearings and shaft adjacent thereto as well as resisting infusion of contaminate particles or fluids into the bearing surfaces.

Figure 4:
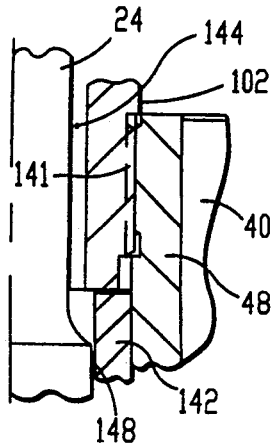
FIG. 4 is an enlarged fragmentary vertical cross sectional view of the area within detail B of FIG. 2 showing the central bearing region.

Flushing water then proceeds generally downwardly through enclosing tube 132 and along shaft 24 and then through adapter 102 as shown in FIG. 4. The flushing water proceeds through annular space 144 between adapter 102 and shaft 24 and then through gap 148 defined between upper bowl bearing 142 and shaft 24 and through the spiraling groove 146 therein. The flushing water then proceeds into chamber 150 before entering the region between bearing support sleeve 152 and shaft 24.

The flushing water is then channeled into the first clearance 164 in through the downwardly spiraling grooves 158 before passing into second clearance 172 and fourth clearance 182. As the water moves beyond retaining ring 168 it enters annular cavity 188, and then moving downwardly through third clearance 180 and into passage 40.

It should be noted that the pump 100 hereof is generally designed to operate in an environment where it is at least partially submerged. Thus, as disclosed in the U.S. Pat. No. 4,063,849 and shown herein, the water line WL defines the surface level of the liquid to be pumped. It may thus be appreciated that, absent some backflow restrictions such as flow restrictor unit 160, the liquid to be pumped, including contaminate particles 190 would move upwardly between the impeller 15 and the conical member 48 and into the first clearance 164 between shaft 24 and lower bowl bearing 156 until the pumped liquid reached a height equivalent to WL within chamber 150.

However, the present invention substantially limits or prevents the infusion of contaminates into the bearing region between lower bowl bearing 156 and shaft 24. When the flushing water is flowing into port 130, the passage 40 and the annular cavity 188 lie downstream of the restrictor bushing. The restrictor bushing 166 acts to restrict the flow rate of the flushing water through the system (lower bowl bearing 156 and those bearings upstream thereof), and also acts as a barrier between the bearing system and the active area of the pump 100 in contact with the pumped liquid moving through passage 40. Thus, second clearance 172 is very narrow and serves not only to limit the entry of particles 190 into the bearing system, but also effectively reduces the amount of water which must be used in flushing the bearing.

The presence of the fourth clearance 184 in conjunction with the second clearance 172 allows the bushing to move with the shaft as the shaft seeks it operating position within the lower bowl bearing 156 and functions as an additional barrier through the activated area of the pump 100 and the bearing system. It is preferred that the flushing water be continuously flowing through the bearing system whether or not the pump 100 is operating. In some cases, this is unacceptable and the bearing flushing system may be turned off when the pump 100 is idle. Under these circumstances, particulate matter 190 suspended within the pump liquid will attempt to invade the bearing system, and particularly first clearance 164. The close running third clearance 180 will act as a filter restricting the size of the particulate matter that can flow through third clearance 180 and into annular cavity 188. The restrictor bushing 166 is provided with an even smaller second clearance 172 and will further filter the size of particulate 190 that can pass into first clearance 164 between the shaft 24 and the lower bowl bearing 156.

Grooves 158 within the lower bowl bearing serve as an additional protection as a part of the bearing flushing system hereof. The remaining particulate matter which is able to flow through second clearance 172 would ordinarily collect in the groove or grooves 158 of lower bowl bearing 156. Upon initiation of the flow of flushing water into the first clearance 164, the particulate matter 190 that has collected in the grooves will be flushed out which is normally accomplished a short time prior to the start-up of the pump 100.

In some circumstances, it may be desirable to permit the flow restrictor bushing 166 to float so that upon the backflow of pumped liquid when the flow of flushing water is stopped, the flow restrictor bushing 166 may be carried upwardly to block the entry of the pumped liquid into the first clearance 164.

We claim:

1. A pump comprising:

a housing having structure defining an inlet, an outlet and a passageway therebetween;

a shaft rotatably coupled with said housing and extending through a portion of said housing into said passageway;

an impeller coupled with shaft in said passageway for rotation with said shaft for impelling a pumpable material from said inlet through said passageway to said outlet, the pumpable material including particulates, said pump being subject to migration of the pumpable material including the particulates from said passageway along said shaft into said housing portion; and an annular member surrounding said shaft and positioned therealong between said housing portion and said passageway, said member having an inner surface and an outer peripheral surface, said housing, member and shaft cooperatively presenting means defining respective clearances between said inner surface and shaft and between said outer surface and housing for allowing transverse shifting of said member relative to said shaft with the size of said clearance being less than the size of the particulates for preventing migration of the particulates into said housing portion.

2. The pump as set forth in claim 1 further including a bearing rotatably coupling said shaft and housing portion.

3. The pump as set forth in claim 2, said annular member being positioned along said shaft between said bearing and said impeller.

4. The pump as set forth in claim 3, said annular member being axially shiftable toward and away from said bearing, said pump further including means for limiting the axial shifting of said member away from said bearing in order to maintain said clearances.

5. The pump as set forth in claim 4 further including means for providing a flow of flushing water along said shaft, through said housing portion, through said clearances and toward said passageway for inhibiting the migration of said pumpable material into said housing portion.

6. The pump as set forth in claim 1, said annular member including a bushing.

* * * * *